US007216693B2

(12) United States Patent
Kapaj et al.

(10) Patent No.: US 7,216,693 B2
(45) Date of Patent: May 15, 2007

(54) STRIP TEMPERATURE REGULATING DEVICE IN A CONTINUOUS METAL STRIP CASTING PLANT

(75) Inventors: Nuredin Kapaj, Udine (IT); Alfredo Bassarutti, Cargnacco (IT); Giampietro Zamo', Udine (IT); Alfredo Poloni, Fogliano Redipuglia (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 10/520,642

(22) PCT Filed: Jul. 10, 2003

(86) PCT No.: PCT/EP03/07490

§ 371 (c)(1),
(2), (4) Date: Jan. 6, 2005

(87) PCT Pub. No.: WO2004/007117

PCT Pub. Date: Jan. 22, 2004

(65) Prior Publication Data

US 2005/0236133 A1 Oct. 27, 2005

(30) Foreign Application Priority Data

Jul. 10, 2002 (IT) ..... MI2002A1506

(51) Int. Cl.
*B22D 11/124* (2006.01)

(52) U.S. Cl. ..... 164/444; 164/428; 164/414

(58) Field of Classification Search ..... 164/444, 164/428, 480, 414, 455
See application file for complete search history.

(56) References Cited

U.S. PATENT DOCUMENTS

| | | | | |
|---|---|---|---|---|
| 3,257,835 | A * | 6/1966 | Cofer et al. | 164/475 |
| 5,094,678 | A * | 3/1992 | Kramer et al. | 65/104 |
| 5,182,074 | A * | 1/1993 | Yoshioka et al. | 266/87 |
| 6,536,504 | B2 * | 3/2003 | Takeuchi et al. | 164/415 |

FOREIGN PATENT DOCUMENTS

| | | | |
|---|---|---|---|
| DE | 197 57 704 A1 | | 7/1998 |
| DE | 19757704 | * | 7/1998 |
| EP | 1 238 727 A2 | | 9/2002 |
| JP | 06 000609 | | 6/1992 |
| JP | 08 294749 | | 11/1996 |
| JP | 10029046 | * | 2/1998 |

* cited by examiner

*Primary Examiner*—Kevin Kerns
*Assistant Examiner*—I.-H. Lin
(74) *Attorney, Agent, or Firm*—Stetina Brunda Garred & Brucker

(57) ABSTRACT

A temperature regulation device for the strip (3) produced in a continuous casting plant with ingot mold (16) comprising a pair of cooled, parallel, counter-rotating rolls (2, 2'), closed by two plates at the axial ends of the rolls, includes a pair of substantially rectangular panels (5) placed symmetrically under the plane of the rolls axis, with its longest dimension substantially parallel to the axis of the rolls. Ducts (6, 8, 8') are provided which feed a series of jets (7) to spray cooling gas onto the strip surface (3).

23 Claims, 4 Drawing Sheets

STRIP TEMPERATURE REGULATING DEVICE IN A CONTINUOUS METAL STRIP CASTING PLANT

CROSS-REFERENCE TO RELATED APPLICATION

This application is a 371 of PCT/EP03/07490 filed on Jul. 10, 2003.

1. Field of the Invention

The present invention relates to a device for the regulation of the strip temperature in a continuous metal strip casting plant and to the method of implementation thereof. More precisely, the present invention relates to the control and regulation of the temperature of the continuously cast strip exiting from the ingot mould.

2. State of the Art

Metallic strips are normally produced starting from continuously cast ingots or slabs, which are reduced in thickness by a series of successive operations comprising the breakdown, hot and cold lamination, together with other intermediate treatments, for example thermal ones. These operating methods involve very expensive plants and considerable energy consumption.

Hence, there has been the trend to reduce equipment and operating costs by casting products with thickness as close as possible to that of the final product; consequently, following the introduction of continuous slab casting, the thickness of the latter is reduced from the conventional 200–300 mm to 60–100 mm obtained in the so called thin slab casting. However, even the passage from 60 mm to 2–3 mm, which is the typical thickness of a hot strip, requires a series of energy demanding steps.

In view of the disadvantages in casting bodies of significant thickness for reduction to thin strips, the advantages in directly casting metallic strips have been recognised since the second half of the $19^{th}$ century, when Sir Thomas Bessemer developed a machine for the continuous casting of steel strip consisting of cooled, counter rotating, metallic casting rolls placed a small distance apart. The metal was cast in the space between the casting rolls, solidified upon contact with the cold walls of the latter and finally extracted with a thickness equal to the gap between the facing walls of the rolls themselves.

Such extremely attractive technology has found practical uses for casting metals such as copper and aluminum only in the last decades of the 20th century, whilst for high melting point metals and alloys, such as steel, at present such technology is still not widely spread in industry.

Numerous efforts are made in this field essentially to reduce production costs, energy consumed and environmental impact, and for producing thin strips usable in particular applications in which, for example, surface quality is not a particular requirement, or for producing thin strips which would undergo the same operations as the hot laminated strips for those uses where thickness' of less than a millimeter are necessary.

As the machine conceived by Bessemer is still, in its general structure, ideal for continuous metallic strip casting, the problems to resolve for its effective use are numerous and range from ensuring maintenance of the gap between the rolls, to finding the most suitable materials to withstand the adverse operating conditions, to automated controlling of the operations, of casting speed and strip driving, up to its coiling. Naturally, the integrity of the strip between casting and coiling is a problem of utmost importance.

As to strip integrity, to avoid that differences in speed between the casting rolls and the coiling mechanism, or roll stand, in the case that there is a roll stand downstream of the casting prior to coiling might lead to breakages, it has been proposed that the strip exiting from the casting ingot mould is made to hang freely under the casting mould itself, and is then raised up by means of driving rolls forming a curve or "loop". It is then sent, guided by a roll conveyor, to the coiling station. Upon variation of casting rolls speed or of the coiling mechanism speed, the length of the loop also varies, without creating further strains on the strip, allowing the control and regulation means to compensate said speed variations. Furthermore, appropriate insulation, heating or cooling means are provided near to the roll conveyor to control and regulate the temperature of the strip, in particular to make it uniform.

As can be seen, such known technology essentially refers to cooling/heating treatments performed following the formation of the loop, and is therefore placed at a distance downstream of the ingot mould, in particular near to the roll conveyor on which the strip, after the loop, is conveyed towards the coiling mechanism.

Both in the presence and the absence of a loop, a problem which presents itself immediately downstream of the ingot mould, when the cast strip leaves the casting rolls, immediately following the so called "kissing point" (KP), namely the point where there is the minimal distance between the casting rolls, is due to the drastic reduction of cooling due to the end of contact with the rolls, which are provided with forced cooling system, and to the passage to a zone in which cooling takes place by irradiation and convection in air, or, alternatively in an inert gas atmosphere provided within the casting zone in order to protect the metal.

Such a distribution of the strip temperature is shown in FIG. 4 where the graph shows the thermal profile of the strip from the meniscus formed by liquid metal above the casting rolls up to a distance of 300 mm below the "kissing point", with curve A for a point on the surface and curve B for a point in the centre of the strip. If the strip is not adequately cooled downstream of the rolls, the temperature can reach, even in the outermost layers, the point of solidification, at which the mechanical properties of the steel are very poor and as a consequence, the strip, in the reheating section, can break under its own weight. In such a manner the production of the strip is discontinuous and the casting line produces only relatively short pieces of strip which cannot be successively rolled.

SUMMARY OF THE INVENTION

An object of the present invention is therefore, that of overcoming the above mentioned drawbacks by providing a strip temperature regulating device which maintains the temperature of the strip, in the zone immediately downstream from the ingot mould, as uniform as possible and at the same time preventing excessive temporary reheating of the strip, or better of its outermost layer, and controlling its cooling.

These problems are solved by a strip temperature regulation device, in a metal strip continuous casting plant equipped with an ingot mould consisting of a pair of parallel, counter-rotating rolls and by two closing plates at the ends of said rolls defining a vertical casting plane of said strip, comprising at least one substantially rectangular panel placed below the plane of the axis of said rolls and with its longest dimension substantially parallel to the axis of said rolls and at least one duct suitable for the passage of cooling gas characterised in that the at least one substantially rectangular panel is placed below the rolls at such a short distance that the temperature of the strip, in the zone immediately upon exit from the ingot mould, is maintained uniform.

The device according to the invention reduces, immediately downstream of the "kissing point" (KP), the heating temperature, the so-called "reheating phenomenon", in a manner such that it does not rise above the steel solidification temperature. Inside the device, which is configured as a deflector, there are advantageously provided appropriate gas distribution channels which communicate with nozzles spraying the gas towards the strip surface, said gas being advantageously inert to avoid undesired oxidation phenomena. This offers the advantage of a reliable cooling system at reduced cost. In other embodiments of the invention, the gas ducts are advantageously placed outside the deflector near to its uppermost and/or lower extremity. In such a case, the deflector is preferably made of resistant material or simply coated with resistant material.

LIST OF THE FIGURES

Other advantages of the present invention will become apparent, to those skilled in the art, from the following detailed description of particular embodiments, given by way of non-limiting examples, of a strip temperature regulation device in a continuous metal strip casting plant with reference to the following Figures, of which FIG. 1 shows a vertical section of a counter rotating roll strip casting plant along a plane orthogonal to the casting plane wherein there is provided a temperature regulation device according to the invention;

DETAILED DESCRIPTION OF PREFERRED EMBODIMENTS OF THE INVENTION

Figure 1:
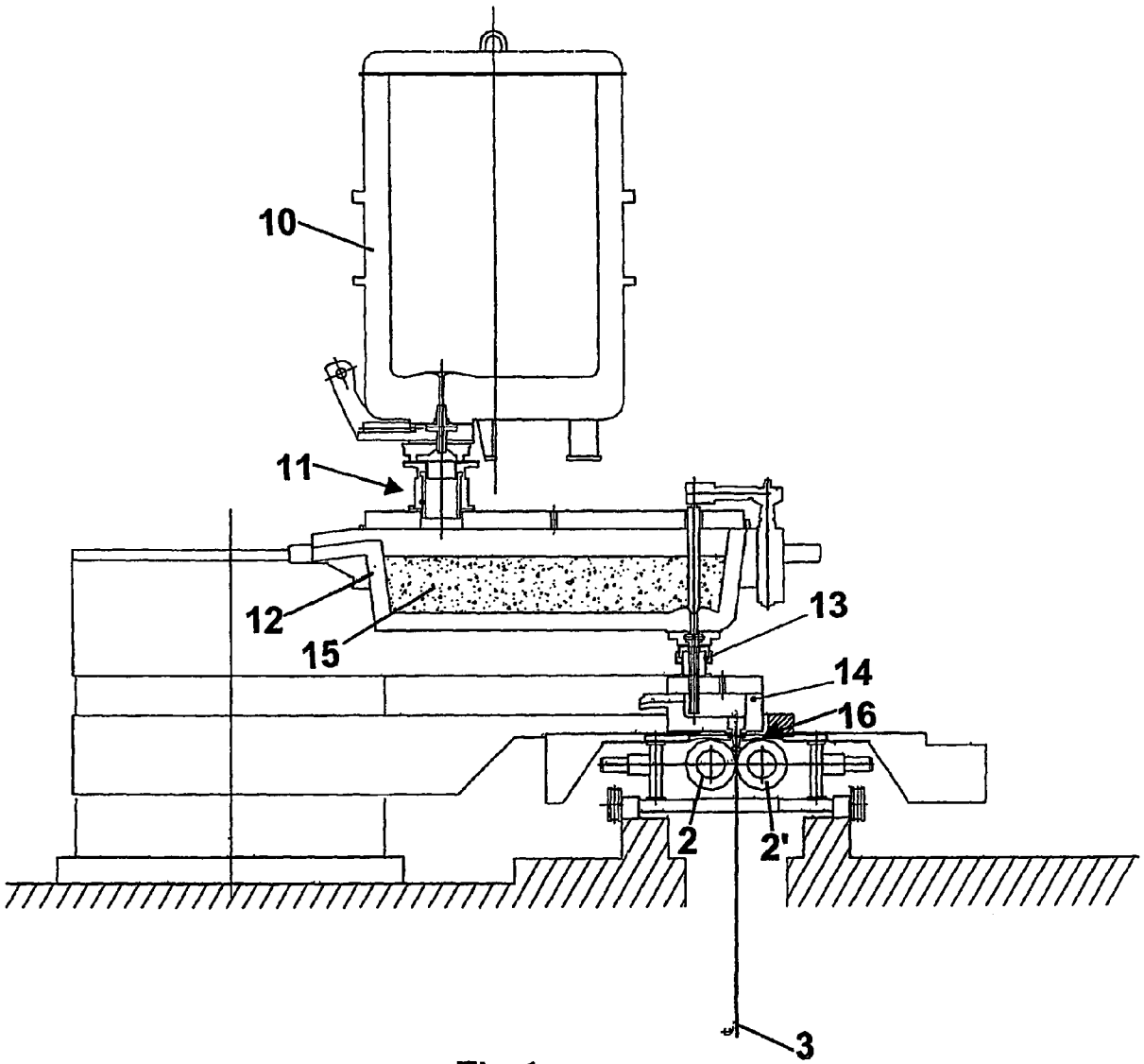

With reference to FIG. 1, a counter-rotating strip casting plant is shown with the principal constituent elements: a ladle 10, an unloader 11, a tundish 12, another unloader 13 and, optionally, an under tundish 14. The steel 15 is poured in a known manner from the tundish to the ingot mould 16.

Figure 2:
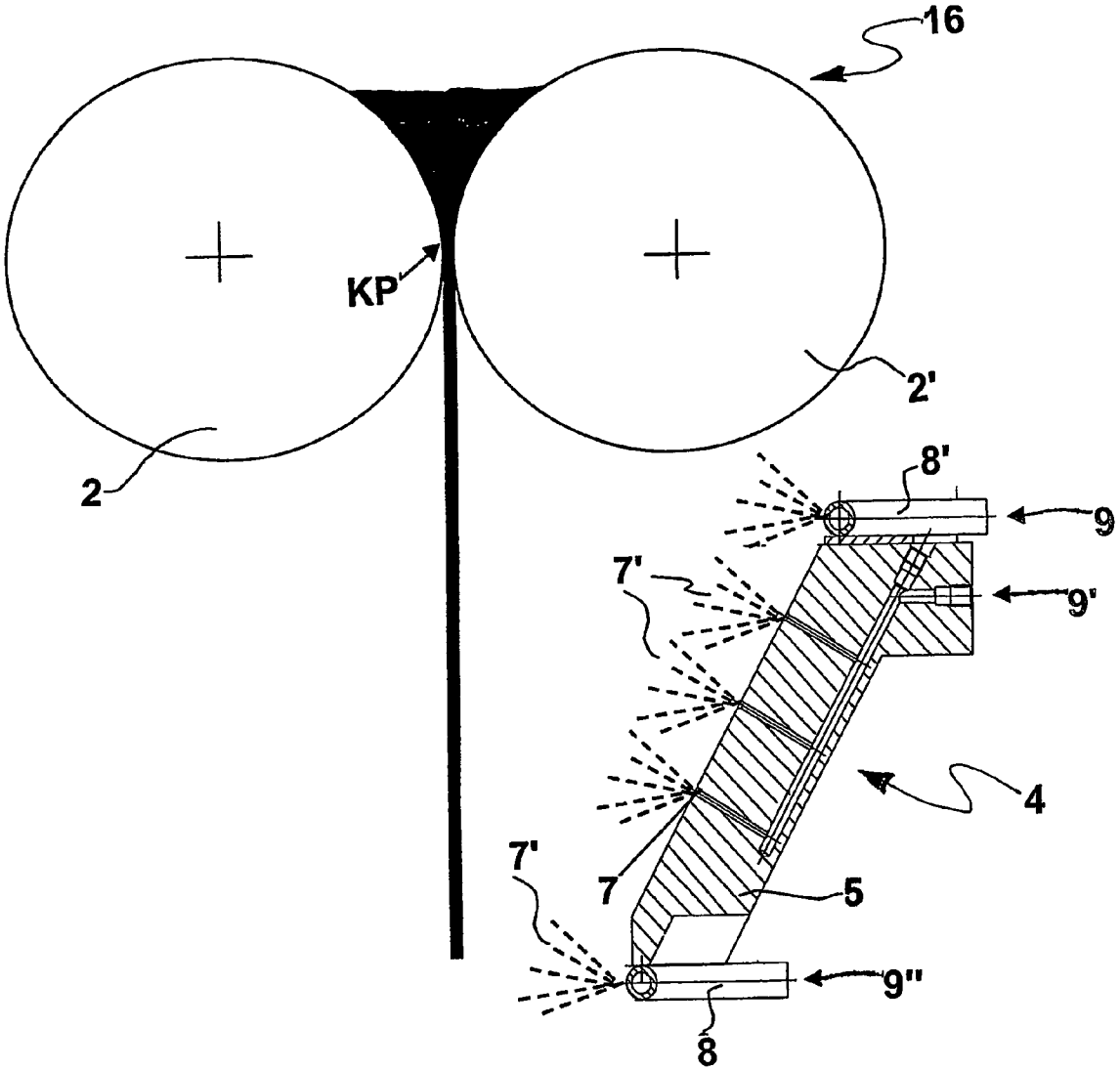
FIG. 2 shows a vertical section along a plane orthogonal to the casting plane, of the zone of the counter-rotating rolls of a metal strip casting line comprising the device according to the invention.
Figure 3:
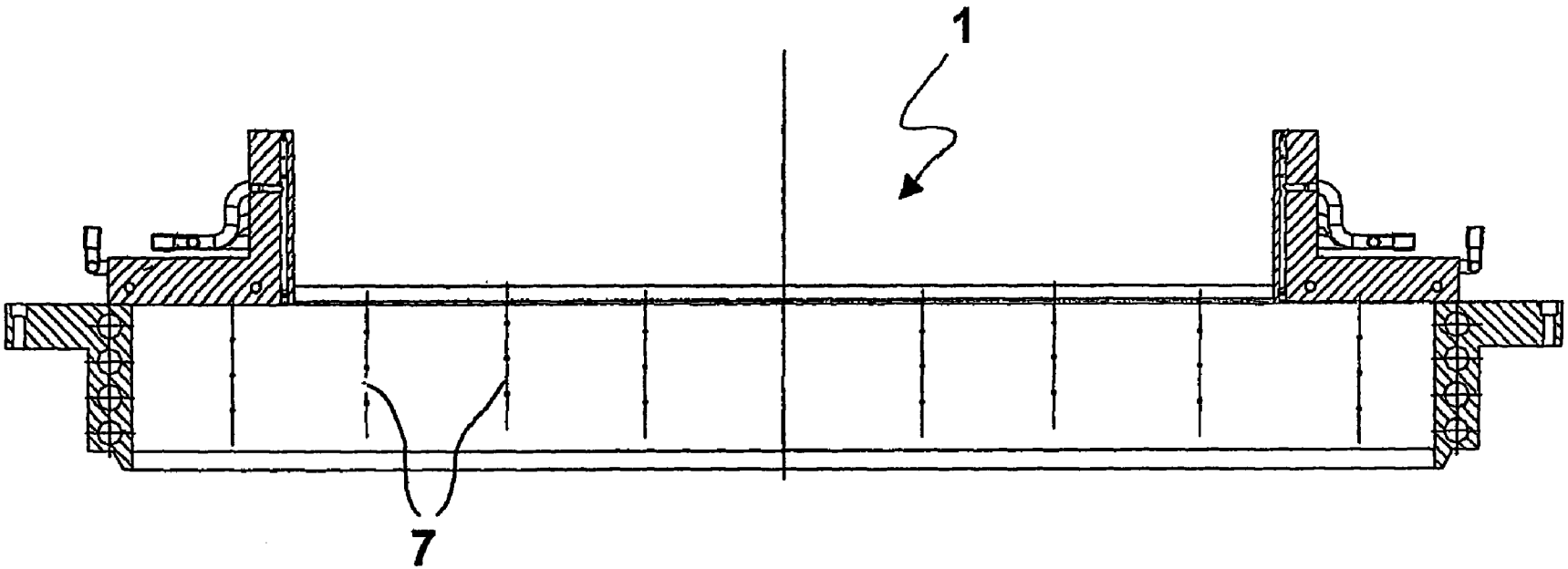
FIG. 3 shows a front view of the device of the invention.

FIG. 2 shows, an enlarged view of the area near to the ingot mould 16 under which the continuous casting of the metal strip is produced 3. The ingot mould 16 substantially comprises a pair of counter-rotating casting rolls 2, 2', internally cooled by appropriate known means and by two end plates placed at the rolls extremities of the of known type, and not shown in the figures.

The molten metal, in the course of the casting process, solidifies upon contact with said rolls 2, 2' near to the "kissing point" KP. The strip 3 exits from the ingot mould 16, still at high temperature, and follows, underneath said ingot mould, initially a vertical path directed towards the bottom.

Figure 4:
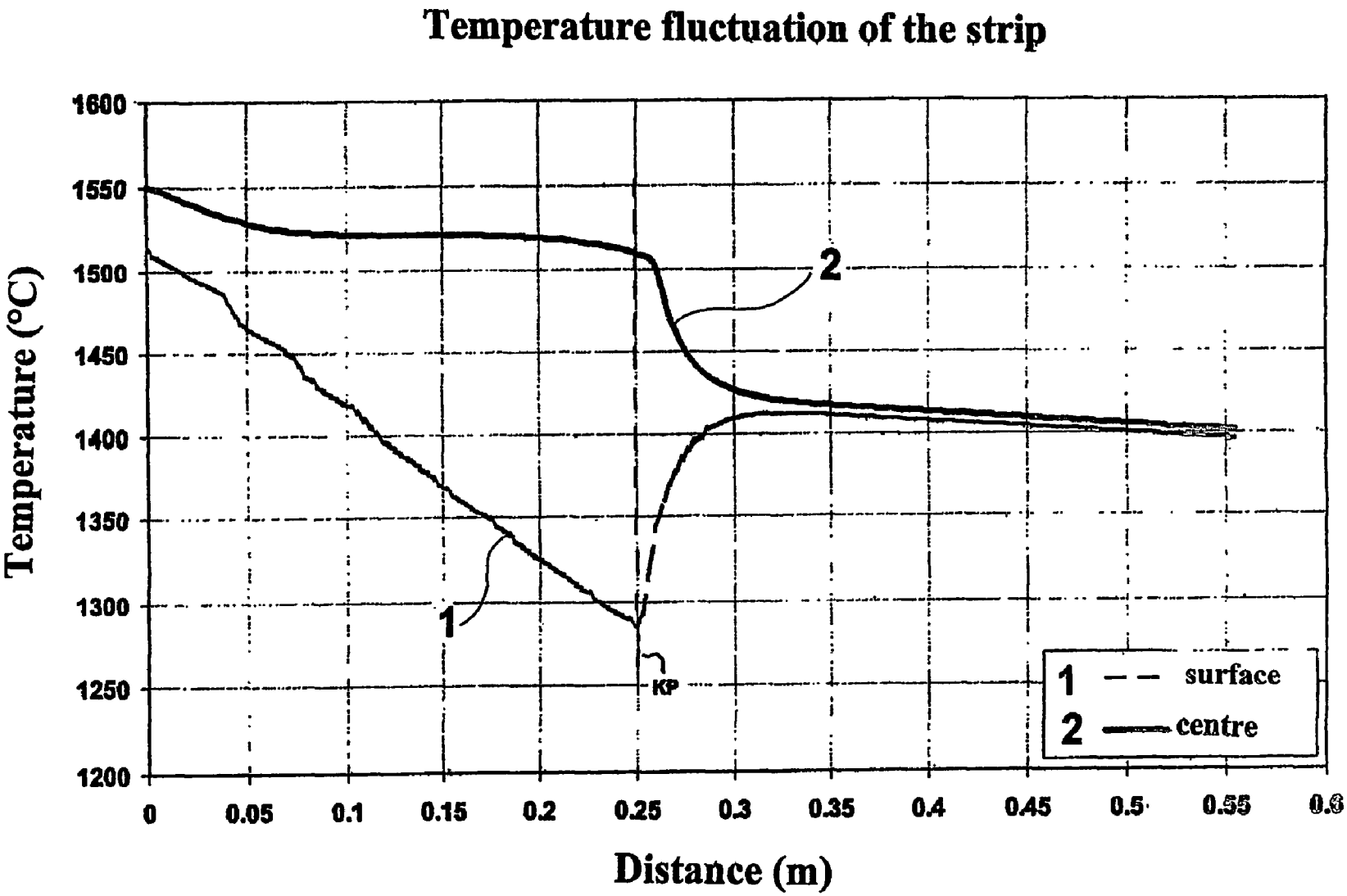
FIG. 4 shows a graph with the curves of the strip temperature, at the strip surface and at the centre, immediately downstream of the rolls in absence of the device in the invention.

In FIG. 4 is illustrated the temperature fluctuation of the cast strip downstream of the ingot mould, without a cooling device in the casting plant. A short distance below the "kissing point" KP, the thermal situation is critical and there is the danger of strip reheating with consequent tearing of the strip caused by its own weight.

With the aim of improving the thermal situation of the strip in the area immediately downstream of the "kissing point" KP, in accordance to the invention, the temperature regulation device 4 is placed a short distance below the rolls 2 and 2'. The device 4 comprises a pair of panels 5 in the shape of a substantially flat elongated rectangular beam. In the following description, reference is made only to one panel 5 and in FIG. 2 only one panel is shown, but it is understood that the device normally comprises two panels placed symmetrically one at each side of the plane defined by the strip.

Panel 5 has appropriate thickness to provide adequate structural resistance, considering also the fact that it is adapted to operate under particularly demanding temperature conditions.

In a first embodiment according to the invention, the thickness of the panel 5 is such as to allow it to house therein a duct 6 for the passage of gas, preferably inert, fed through by manifolds 9'. The duct 6 communicates with the nozzles 7 placed on the surface of the device facing the casting strip 3 and directed towards the outside, preferably in the direction of the strip 3 so as to cool its surface by means of the gas jets 7'.

In a second advantageous embodiment of the temperature regulation device 4, still shown in FIG. 2, ducts 8, 8', e.g. tubes of varying section, are arranged above and/or below and close to the panel 5. Tubes 8, 8' have nozzle-shaped holes to spray the gas towards the strip 3. In this embodiment the internal ducts 6 and the nozzles 7, can also be absent from panel 5, for example if the regulation effect of the gas emitted by the tubes 8, 8' is sufficient for the plant requirements.

The tubes 8, 8' can also be more than one, if such a lay out is necessary to improve the temperature regulation effect.

Panel 5, in the embodiments just described, is made in metal or alternatively in a refractory material. Alternatively, panel 5 can also be made of metal coated with a coating of refractory material.

Panel 5 In refractory material is suitable also for protecting ducts 8, 8' in case of loss of molten steel from the rolls in case the casting is interrupted and the molten steel content still present in the ingot mould must be quickly unloaded into the space under the rolls. With an appropriate arrangement of the ducts 8, 8' it is possible to position them such that a possible falling of a notable quantity of liquid steel does not squashes directly onto them. This is particularly useful in the case of emergency emptying of the ingot mould.

Feeding the device 4 with a gas at an appropriate temperature and pressure and sufficient flow rate produces a spraying effect which flows over the strip surface in the most critical area for the temperature and appropriately cools the surface, eliminating the risk of breakage when the strip reaches a considerable weight after a predetermined period of casting has been performed.

Panel 5 is preferably placed with its surface turned towards the strip inclined at a predetermined acute angle, for example approx. 30°, with respect to the vertical strip casting plane.

The section of panel 5 can also substantially assume an L shape to increase the structural resistance thereof.

Advantageously, the device 4 provides horizontal hinges with axes essentially parallel to these of the crystallising rolls and the possibility to make pivot the entire plane of the device or just of panel 5 to vary the angle of attack with respect to the vertical plane parallel to the strip, with the possibility of varying the effect of the gas jets on the surface of the strip 3.

Further downstream from the cooling device 4 of the invention it can be advantageous to provide other equipment or temperature control devices to optimally regulate heat exchange between the cast strip and the environment. It can also be advantageous to thermally isolate the environment, and to provide substantially gas tightness to the chamber under the ingot mould where the casting takes place, in order to reduce losses to a minimum and to prevent entry of atmospheric air which favours the phenomenon of surface oxidation of the strip. The regulating device according to the invention can also provide a strip temperature survey system to enable regulation of the gas flow emitted by the nozzles, based on the temperature of the cast metal and of its solidification temperature.

An embodiment of the device also provides for the presence of only one panel placed on one side of the strip if this is necessary for the temperature regulation of the strip. Similar regulatory effects can also be obtained in the case in which the device has two panels on the two faces of the strip, but in which only gas ducts of one side are utilised.

The invention claimed is:

1. A metal strip continuous casting plant equipped with an ingot mould and strip temperature regulation device comprising a pair of parallel, counter-rotating rolls and two closing plates at the ends of said rolls defining a vertical casting plane of said strip, wherein the strip temperature regulation device comprises at least one substantially rectangular panel wherein the rectangular panel has its longest dimension substantially parallel to the axis of said rolls, has at least one conduit suitable for the passage of cooling gas is placed below the plane of the axis of said rolls at such a short distance from the rolls that the temperature of the strip, in the zone immediately upon exit from the ingot mould, is maintained uniform along its length, is made of refractory material, has means for varying the inclination with respect to the vertical strip casting plane and is inclined at a predetermined angle of value different from zero with respect to said vertical strip casting plane.

2. The device according to claim 1, wherein there are provided outlet nozzles of said at least one conduit adapted for spraying gas towards the strip.

3. The device according to claim 2, wherein said conduits are formed inside said at least one panel.

4. The device according to claim 2, wherein said conduits are located externally alongside said at least one panel.

5. The device according to claim 4, wherein there are provided more than one conduits.

6. The device according to claim 5, wherein said at least one panel has means for varying the inclination with respect to the vertical strip casting plane.

7. The device according to claim 6, wherein the two panels have means for varying their inclination with respect to the vertical strip casting plane.

8. The device according to claim 1, wherein there are provided two panels placed symmetrically at each side of said vertical strip casting plane.

9. A metal strip continuous casting plant equipped with an ingot mould and strip temperature regulation device comprising a pair of parallel, counter-rotating rolls and two closing plates at the ends of said rolls defining a vertical casting plane of said strip, wherein the strip temperature regulation device comprises at least one substantially rectangular panel placed below the plane of the axis of said rolls and with its longest dimension substantially parallel to the axis of said rolls and at least one conduit suitable for the passage of cooling gas wherein the at least one substantially rectangular panel is placed below the rolls at such a short distance from the rolls that the temperature of the strip, in the zone immediately upon exit from the ingot mould, is maintained uniform along its length, wherein at least one panel is adjustably inclined at an angle of value different from zero with respect to said vertical strip casting plane.

10. The device according to claim 9, wherein there are provided outlet nozzles of said at least one conduit adapted for spraying gas towards the strip.

11. The device according to claim 10, wherein said conduits are formed inside said at least one panel.

12. The device according to claim 11, wherein said at least one panel has means for varying the inclination with respect to the vertical strip casting plane.

13. The device according to claim 10, wherein said conduits are located externally alongside said at least one panel.

14. The device according to claim 13, wherein there are provided more than one conduits.

15. The device according to claim 14, wherein said at least one panel has means for varying the inclination with respect to the vertical strip casting plane.

16. The device according to claim 9, wherein there are provided two panels placed symmetrically at each side of said vertical strip casting plane.

17. The device according to claim 16, wherein the two panels have means for varying their inclination with respect to the vertical strip casting plane.

18. The device according to claim 9 wherein at least one panel is made of refractory material.

19. A metal strip continuous casting plant comprising:

a pair of parallel, counter-rotating rolls for continuously casting a metal strip; and a strip temperature regulation device comprising:

at least one panel placeable below the rolls and adjacent the metal strip at an angle greater than zero such that an upper distal end of the panel is further away from the metal strip compared to a lower distal end of the panel;

a plurality of nozzles disposed on a panel proximal surface which faces the metal strip for dispersing cooling medium toward the metal strip;

a plurality of ducts in fluid communication with the nozzles for routing the cooling medium to the nozzles.

20. The plant of claim 19 wherein the cooling medium is a gas.

21. The plant of claim 19 wherein the panel has an L shape.

22. The plant of claim 19 wherein the panel is pivotably hinged at the lower distal end thereof for adjusting the angle of the panel to the metal strip.

23. The plant of claim 19 wherein the angle of the panel to the metal strip is 30 degrees.

* * * * *